US010869544B2

(12) United States Patent
Lambertson, Jr.

(10) Patent No.: US 10,869,544 B2
(45) Date of Patent: Dec. 22, 2020

(54) BRUSH HANDLE ASSEMBLY AND METHOD FOR MAKING

(71) Applicant: The Sherwin-Williams Company, Cleveland, OH (US)

(72) Inventor: Michael C. Lambertson, Jr., Aurora, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 0 days.

(21) Appl. No.: 16/180,627

(22) Filed: Nov. 5, 2018

(65) Prior Publication Data

US 2020/0138183 A1 May 7, 2020

(51) Int. Cl.
*A46B 17/02* (2006.01)
*A46D 99/00* (2006.01)

(52) U.S. Cl.
CPC ..... *A46B 17/02* (2013.01); *A46D 99/00* (2013.01)

(58) Field of Classification Search
CPC ..... A46B 17/02; A46B 3/12; A46B 5/021; A46B 7/042; A46D 99/00
See application file for complete search history.

(56) References Cited

U.S. PATENT DOCUMENTS 2,508,931 A 5/1950 Simms
2,664,582 A * 1/1954 Kammann ..... A46B 5/06 15/143.1
2,709,272 A 5/1955 Pettengill
2,874,399 A 2/1959 Friedman
2,993,221 A 7/1961 Bedell
3,030,649 A 4/1962 Karlan et al.
3,076,989 A 2/1963 Daw
3,090,063 A 5/1963 Weiss et al.
3,112,509 A 12/1963 Weiss
3,130,434 A 4/1964 Daw
3,133,299 A * 5/1964 Danley ..... A46B 15/00 15/193
3,146,480 A 9/1964 Weiss
3,153,801 A 10/1964 Weiss et al.
3,155,998 A 11/1964 Hardman et al.
3,172,141 A 3/1965 Arena
3,192,549 A 7/1965 Weiss et al.
3,231,920 A 2/1966 Malpas
3,263,259 A 8/1966 Shulman
3,276,063 A 10/1966 Harrison
3,292,199 A 12/1966 Laurizio
3,323,162 A 6/1967 Laurizio
3,757,376 A * 9/1973 Coombes ..... A46B 3/12 15/202
6,408,474 B1 * 6/2002 Husted ..... A46B 3/12 15/143.1
9,403,269 B1 * 8/2016 Typrowicz ..... B25G 3/12
(Continued)

*Primary Examiner* — Marc Carlson
(74) *Attorney, Agent, or Firm* — Hahn Loeser & Parks LLP; Daniel J. Smola

(57) ABSTRACT

Examples of the present disclosure include apparatus and methods for making a brush handle assembly. Specifically, the present disclosure is for a brush handle assembly comprising a flexible handle, an intermediate connector, and a ferrule. In particular, the present disclosure is for an improved interface between each of the flexible handle, the intermediate connector, and the ferrule for an improved construction providing increased durability and longevity.

20 Claims, 9 Drawing Sheets

(56) References Cited

U.S. PATENT DOCUMENTS

| | | | | |
|---|---|---|---|---|
| 9,526,325 | B2 * | 12/2016 | Hesse | A46B 11/00 |
| 2001/0020315 | A1 | 9/2001 | Lallement et al. | |
| 2002/0004963 | A1 * | 1/2002 | Woodnorth | A46B 3/08 15/160 |
| 2002/0148058 | A1 | 10/2002 | Greenwood et al. | |
| 2013/0019424 | A1 | 1/2013 | Page | |

* cited by examiner

BRUSH HANDLE ASSEMBLY AND METHOD FOR MAKING

BACKGROUND

The invention described herein relates to a brush handle assembly and a method for making a brush handle assembly.

Surface coatings are applied to a variety of surfaces using applicator devices. One such applicator device is a brush. Brushes are generally constructed of an applicator end and a handle where the applicator extends from the handle. The handle is provided to maintain control of the applicator end. An applicator end may be constructed of bristles, foam, or cloth. Materials commonly used for a handle include wood and plastics.

Various brush handle assemblies are constructed of multiple materials. By example, the handle may be constructed of a material for enhanced ergonomic support and the applicator end may be constructed of a material for enhanced surface coating application. In prior brush handle designs, flexible brush handles have been provided to enhance comfort, improve maneuverability, provide grip support, and/or reduce user fatigue. These flexible handles, however, do not provide the strength, durability, or support necessary to withstand long-term continuous use and/or aggressive use. In particular, prior flexible handles fail at the interface between the handle and the applicator end. An improved interface between a flexible brush handle and an applicator end is desired and provided herein. With the improved flexible handle, an improved ergonomic brush handle is also desired and provided herein.

SUMMARY

The brush handle assembly of the present disclosure provides an ergonomic handle configuration that is flexible and durable. In particular, the brush handle assembly comprises an intermediate connector which increases the durability of the flexible handle at an interface with a ferrule. The brush handle assembly of the present disclosure may be used with a variety of applicator designs and is combinable with a variety of applicator ends to form a variety of applicator devices. The following description and annexed drawings set forth in detail certain illustrative examples of the disclosure, being indicative of but a few of the various ways in which the principles of the disclosure may be employed.

In one example, a brush handle assembly comprises a ferrule, an intermediate connector, and a flexible handle. The flexible handle is positioned within a top side of the intermediate connector and at least one lateral side of the intermediate connector. The intermediate connector is positioned within a top side of the ferrule and is substantially or fully concealed by the ferrule. In one specific example, the ferrule is permanently attached to the intermediate connector and the flexible handle is permanently attached to the intermediate connector.

In specific examples, the flexible handle is molded into a cavity of the intermediate connector. The flexible handle may further comprise one or more cleats extending through, or penetrating, one or more respective sidewall apertures of the intermediate connector. To further secure the intermediate connector to the ferrule, the ferrule may comprise a crimp which is crimped into an exterior void of the intermediate connector.

Specific examples of a brush handle assembly may also comprise a contoured flexible handle. The flexible handle may also comprise a raised profile. The raised profile may be offset to one side of the flexible handle. In one particular example, the raised profile comprises at least three concave sections.

Additional examples of the intermediate connector are provided in the present disclosure. In one example, the intermediate connector for use in a brush handle assembly may comprise a bottom side, a top side, and a cavity formed therein and open at the top side. The intermediate connector may further comprise at least one sidewall aperture extending from the cavity through a sidewall between the bottom side and the top side. The intermediate connector may further comprise at least one support rib extending across the cavity at the top side. The at least one support rib may extend a partial depth or the full depth of the cavity, from the top side of the intermediate connector to the bottom side of the intermediate connector. The at least one support rib may additionally bisect at least one sidewall aperture. In some examples, the intermediate connector may further comprise a top lip, a taper at the bottom side, and/or bottom side voids.

Additional examples of the present disclosure include methods for assembling a brush handle assembly. Particular examples of a method for assembling a brush handle assembly comprise:

- Molding a flexible handle into a cavity open at a top side of an intermediate connector;
- Extending one or more cleats of the flexible handle through a sidewall aperture of the intermediate connector for securing the flexible handle to the intermediate connector;
- Inserting a bottom side of the intermediate connector into a top side of the ferrule wherein the one or more cleats of the flexible handle are exposed to an inside surface of the ferrule through the intermediate connector; and
- Crimping the ferrule into an exterior void of the intermediate connector.

The foregoing and other objects, features and advantages of the invention will be apparent from the following more detailed descriptions of particular embodiments of the invention, as illustrated in the accompanying drawings wherein like reference numbers represent like parts of the invention.

BRIEF DESCRIPTION OF THE DRAWINGS

Reference is made to the accompanying drawings in which particular examples and further benefits of the invention are illustrated as described in more detail in the description below, in which.

DETAILED DESCRIPTION

The present disclosure includes apparatus and methods for making a brush handle assembly. Specifically, the present disclosure is for a brush handle assembly comprising a flexible handle, an intermediate connector, and a ferrule. The present brush handle assembly provides for a flexible brush with increased durability and longevity. In particular, the interface between the flexible handle, the intermediate connector, and the ferrule reduces or eliminates failure of the brush handle assembly at high stress locations.

Figure 1:
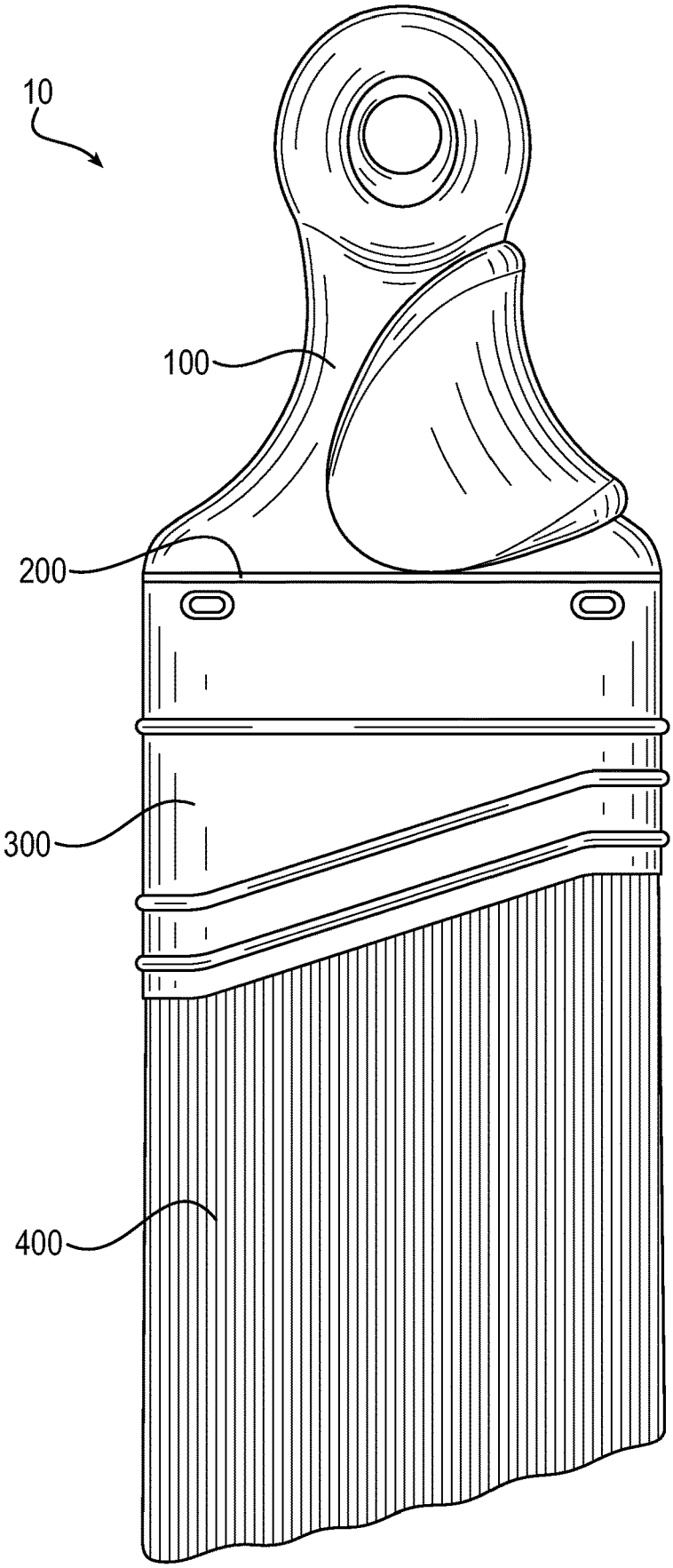
FIG. 1 is a front view of a brush handle assembly, in accordance with an example.

Referring to FIG. 1, an example of a brush handle assembly 10 comprising a flexible handle 100, an intermediate connector 200, and a ferrule 300 is illustrated. An applicator end 400, such as bristles, may further extend from the ferrule 300 of the brush handle assembly. The flexible handle is made of rubber or plastic while maintaining flexible characteristics. The intermediate connector may be a hard plastic base constructed of polypropylene, for example. The ferrule may be constructed of a metal. In specific examples, the handle material may be constructed from TPR (thermoplastic rubber), TPE, thermoplastic elastomer, or TPV (thermoplastic vulcanizate, such as Santoprene™). The various handle constructions may span all possible shore hardness values. In specific examples, the intermediate connector may be constructed from any thermoplastic, including all blends/varieties of Polypropylene, all blends/varieties of Polyamide (nylon), and all blends/varieties of POM (Polyoxymethylene, such as Acetal and/or Delrin®). In specific examples, ferrule material may include ETP (electrolytic tin plate, commonly referred to as "coke" tin), brass antique brass, nickel, nizon, copper (or other typical decorative plating on top of the ETP), stainless steel, and/or thermoplastics.

Figure 2:
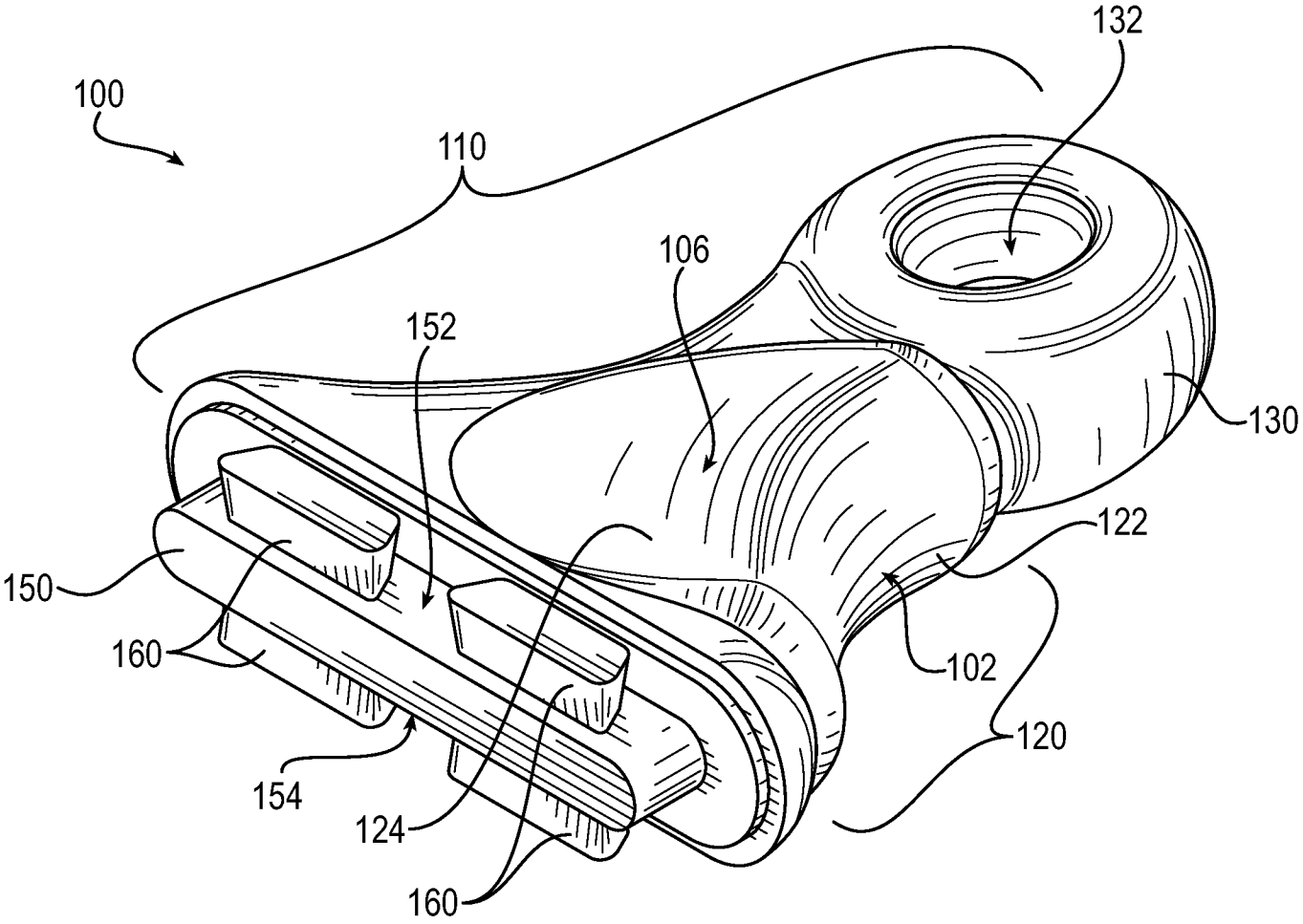
FIG. 2 is a perspective view of a flexible handle with the intermediate connector removed for clarity, in accordance with an example.

Turning to FIGS. 2-7, an example of the flexible handle 100 is illustrated. FIG. 2 illustrates a perspective view of the flexible handle 100. The flexible handle 100 comprises a grip 110 and an insert 150. The grip 110 extends from the intermediate connector when the brush handle assembly is assembled. The insert 150 is inserted into the intermediate connector for securing the flexible handle to the intermediate connector when the brush handle assembly is assembled.

Figure 3:
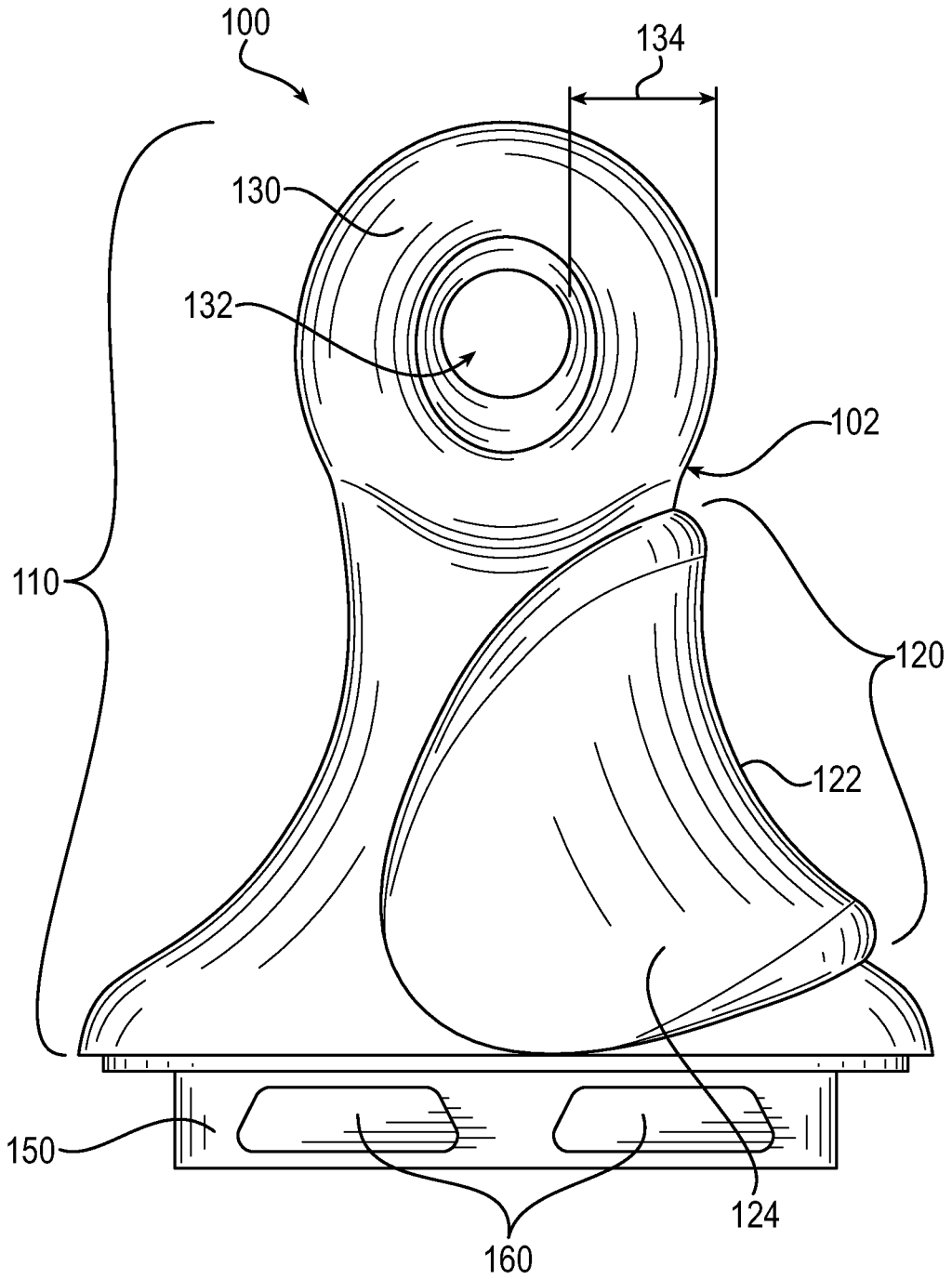
FIG. 3 is a front view of a flexible handle with the intermediate connector removed for clarity, in accordance with an example.
Figure 4:
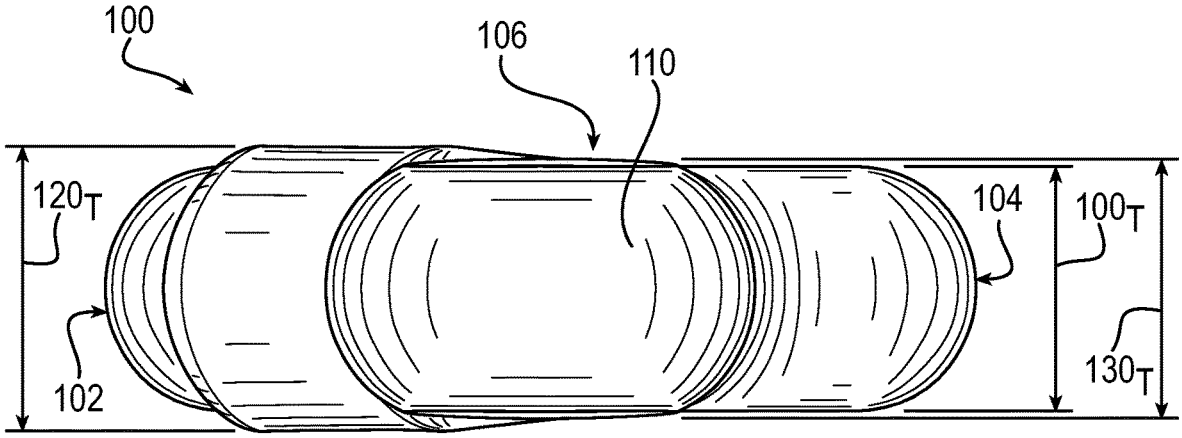
FIG. 4 is top view of a flexible handle, in accordance with an example.
Figure 5:
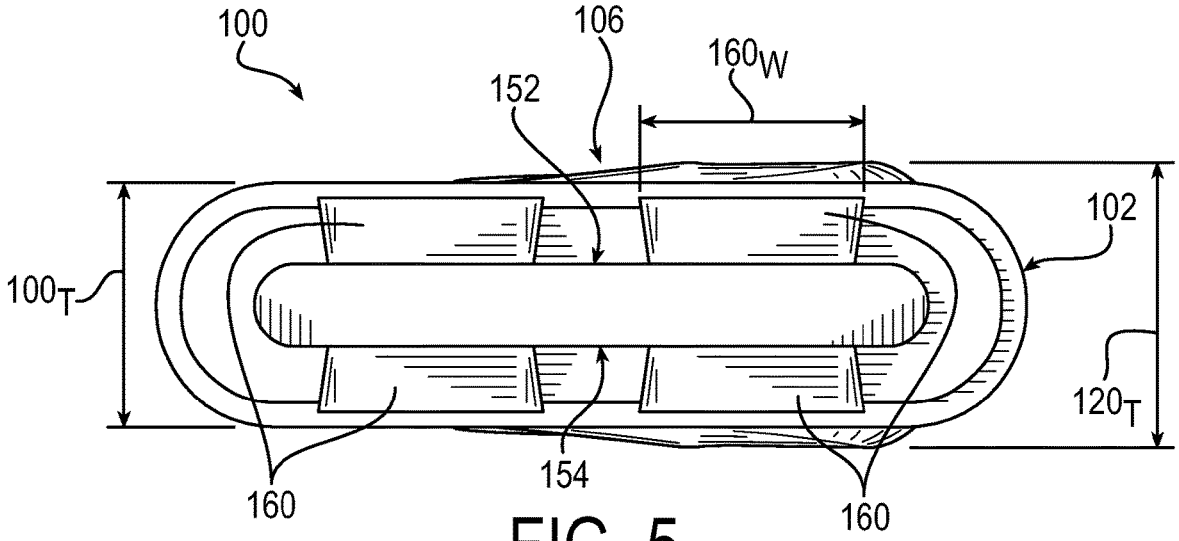
FIG. 5 is a bottom view of a flexible handle with the intermediate connector removed for clarity, in accordance with an example.

In the example as illustrated by FIG. 2, the grip 110 of the flexible handle 100 comprises a raised profile 120 which is offset, or off-center, to a first side 102 of the flexible handle 100. The raised profile is of an ergonomic design for reducing user fatigue during continuous and/or aggressive use of the brush handle assembly. In particular, the raised profile 120 comprises one or more contours for mating with the purlicue of a user's hand. With particular reference to FIGS. 2-3, a first contour 122 may be provided on the first side 102 of the flexible handle for mating with the purlicue. A second contour 124 may be provided at the front 106 of the flexible handle for indexing a user's finger or thumb. A third contour, opposite the second contour 126, may be provided at the back of the flexible handle for indexing a user's palm. In other words, multiple contours, such as three contours, may be provided on the raised profile 120 for indexing a user's hand. As further illustrated by FIGS. 4-7 the first 122, second 124, and third 126 contours of the raised profile 120 are each convex. The raised profile 120 has a thickness $\mathbf{120}_T$ greater than the thickness $\mathbf{100}_T$ of the flexible handle 100 at a second side 104. The raised profile thickness $\mathbf{120}_T$ and the handle thickness $\mathbf{100}_T$ are illustrated by FIGS. 4-5.

As illustrated by FIGS. 2-3, the flexible handle may also comprise a handle top side 130. In this example, the handle top side 130 comprise a thickness $\mathbf{130}_T$ greater than the thickness $\mathbf{100}_T$ of the flexible handle 100 at the second side 104. The topside thickness $\mathbf{130}_T$ and the handle thickness $\mathbf{100}_T$ are illustrated by FIG. 4.

The handle top side 130 may also comprise a top side aperture 132. Here, the top side aperture 132 is circular and forms a cylinder extending through the thickness of the flexible handle 100. The top side aperture 132 may receive a lanyard for hanging the brush handle assembly and/or for receiving a strap for suspending a tag at the point of sale, for example. A thickened wall section 134 forms a perimeter of the top side aperture 132. Below the handle top side 130, a width $\mathbf{110}_W$ of the grip increases in a direction toward the insert 150 of the flexible handle as illustrated by FIG. 3.

Figure 7:
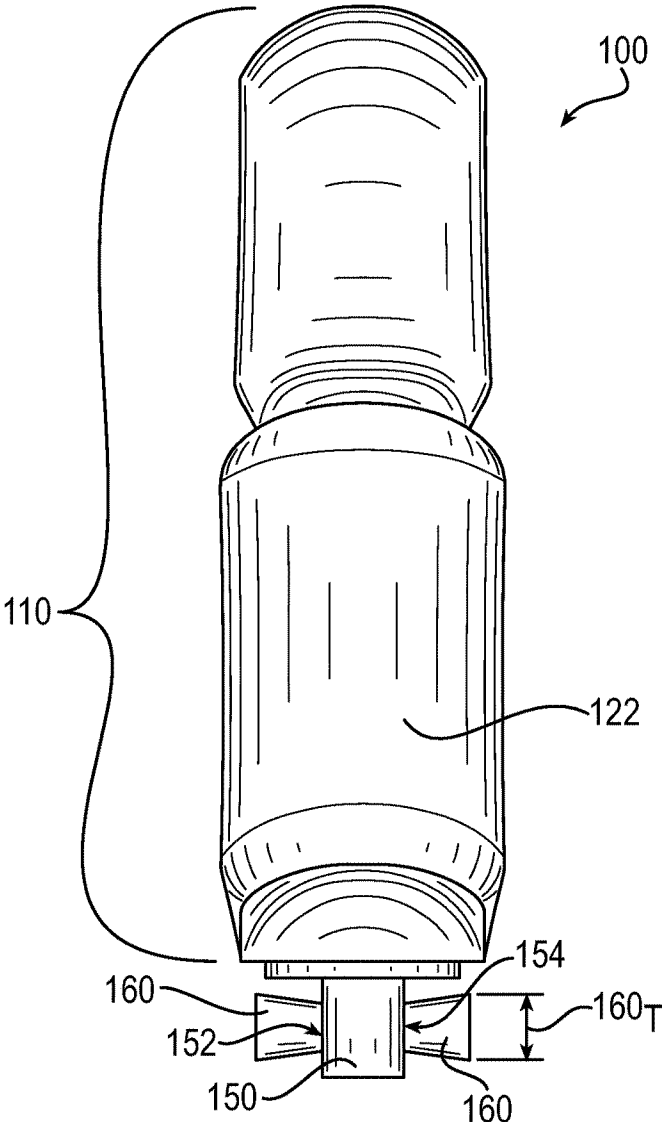
FIG. 7 is a side view of a flexible handle with the intermediate connector removed for clarity, in accordance with an example.
Figure 6:
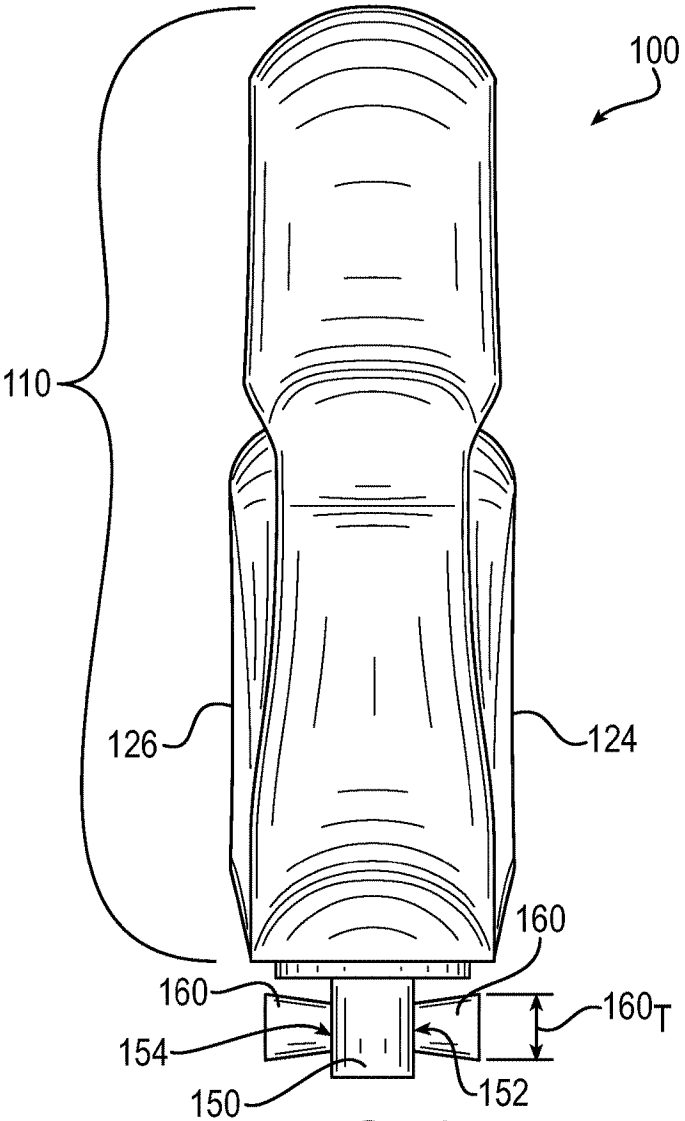
FIG. 6 is a side view of a flexible handle at a raised profile with the intermediate connector removed for clarity, in accordance with an example.

The insert 150 extends from below the grip 110 and is inserted into and concealed within the intermediate connector 200 when the brush handle assembly is assembled. The insert 150 may comprise one or more cleats 160 for securing the flexible handle 100 to the intermediate connector. In FIG. 2, the insert 150 comprises four cleats 160. Any number of cleats are contemplated herein. In one example, one cleat may be provided. In yet another example, multiple cleats may be provided. As illustrated by FIGS. 5-7, the cleats 160 extend laterally outward from a front 152 and a back 154 of the insert, respectively. Here, each cleat forms a trapezoid extending from the insert. The cleat is shaped to mate with a respective sidewall aperture of the intermediate connector. As illustrated by FIG. 5, The width of each cleat $\mathbf{160}_W$ increases as the cleat extends from the insert 150. As illustrated by FIGS. 6-7, the thickness of each cleat 160T additionally increases as the cleat extends from the insert 150. This provides a locking engagement at the sidewall aperture of the intermediate connector when positioned in the intermediate connector.

Figure 8:
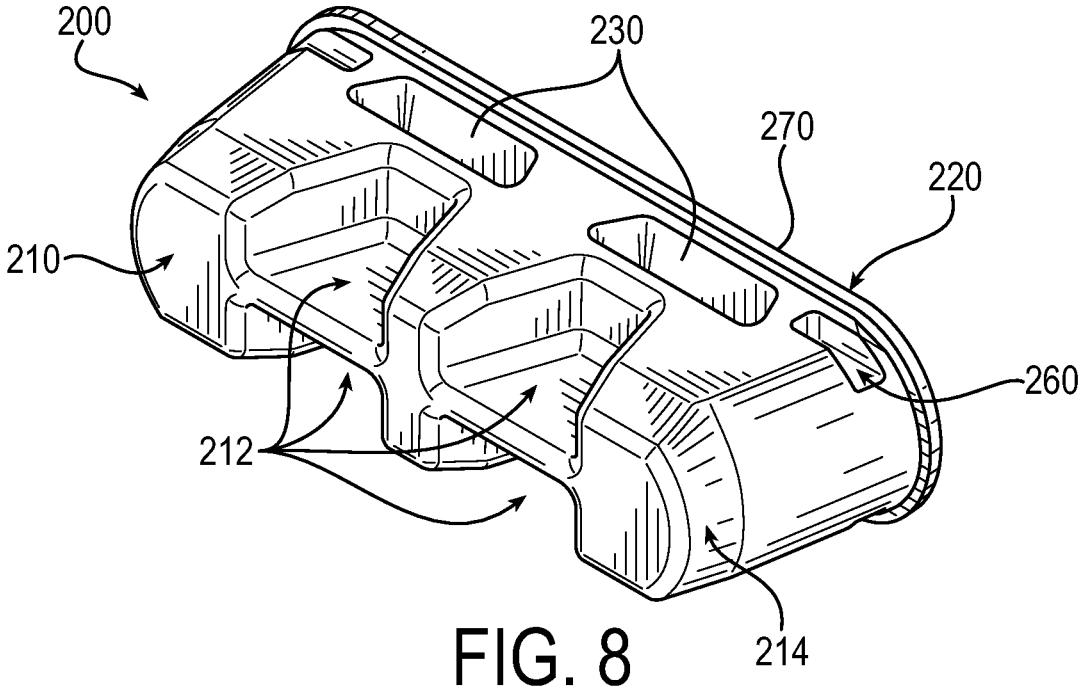
FIG. 8 is a bottom side perspective view of an intermediate connector with the flexible handle removed for clarity, in accordance with an example.

Turning to FIG. 8, a perspective view of the bottom side 210 of the intermediate connector 200 is illustrated. The bottom side 210 is inserted into a top side of the ferrule when the brush handle assembly is assembled. Illustrated by FIG. 8 are bottom side voids 212. The bottom side voids 212 are provided to increase the rigidity and strength of the intermediate connector within the ferrule. The bottom side 210 of the intermediate connector 200 forms a taper 214, or reduces in thickness $\mathbf{200}_T$, as the intermediate connector transitions toward the bottom side 210 as illustrated by FIG. 10.

Figure 9:
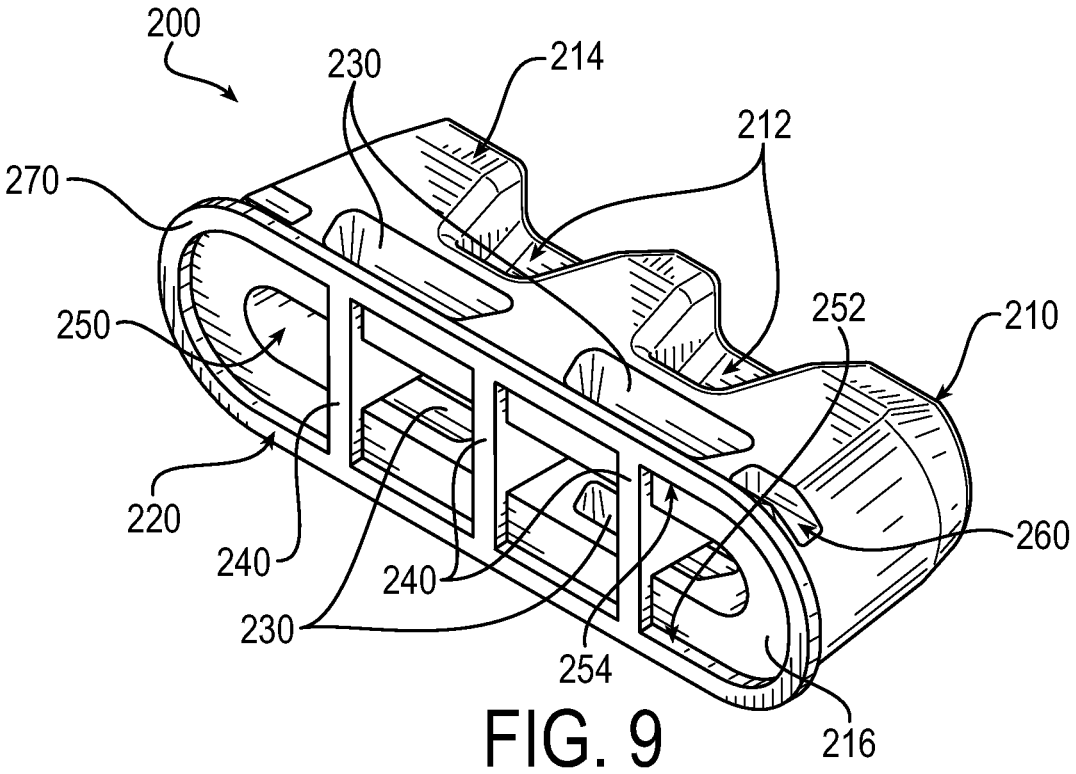
FIG. 9 is a top side perspective view of an intermediate connector with the flexible handle removed for clarity, in accordance with an example.
Figure 11:
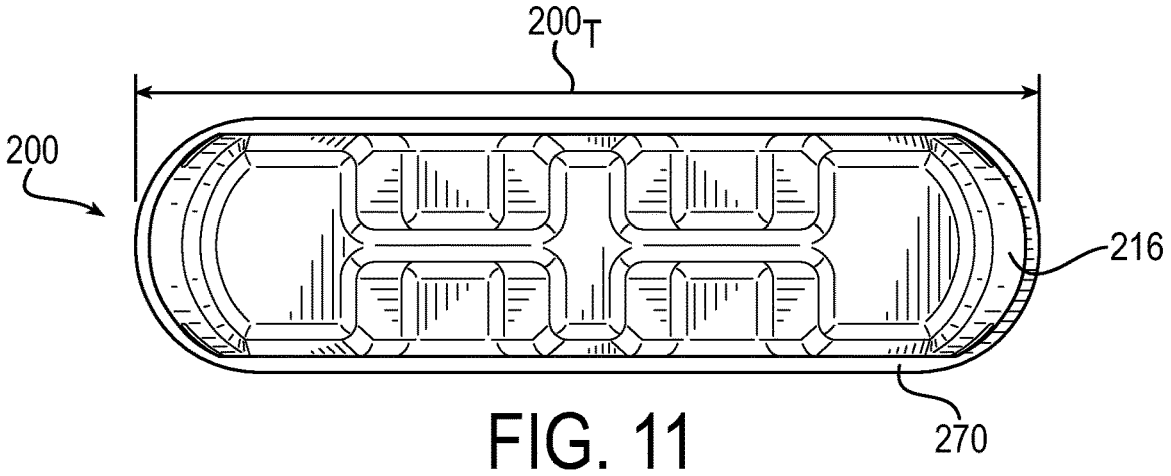
FIG. 11 is a bottom view of a cavity of an intermediate connector with the flexible handle removed for clarity, in accordance with an example.
Figure 12:
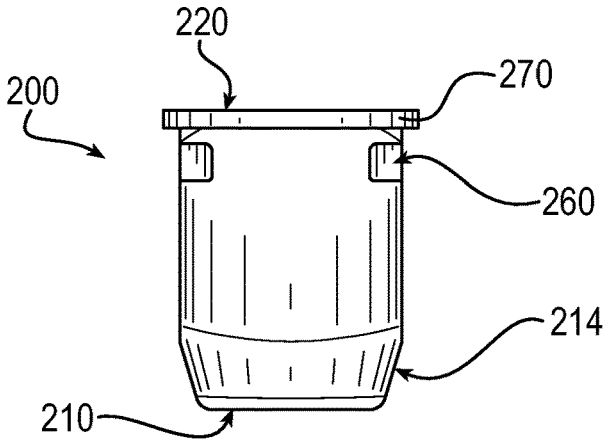
FIG. 12 is a side view of an intermediate connector with the flexible handle removed for clarity, in accordance with an example.

FIG. 9 illustrates a perspective view of the top side 220 of the intermediate connector 200. A cavity 250 is formed within the intermediate connector 200 for receiving the insert 150 of the flexible handle when the brush handle assembly is assembled. The insert of the flexible handle may be molded into the cavity 250. As illustrated by FIGS. 9 and 11, the intermediate connector 200 comprises thickened wall sections 216 for strength and rigidity. Upon inserting the flexible handle into the cavity 250 the strength and rigidity exhibited by the taper 214, the bottom side voids 212, and the thickened wall sections 216 are transferred to the flexible handle by way of the flexible handle insert.

Figure 10:
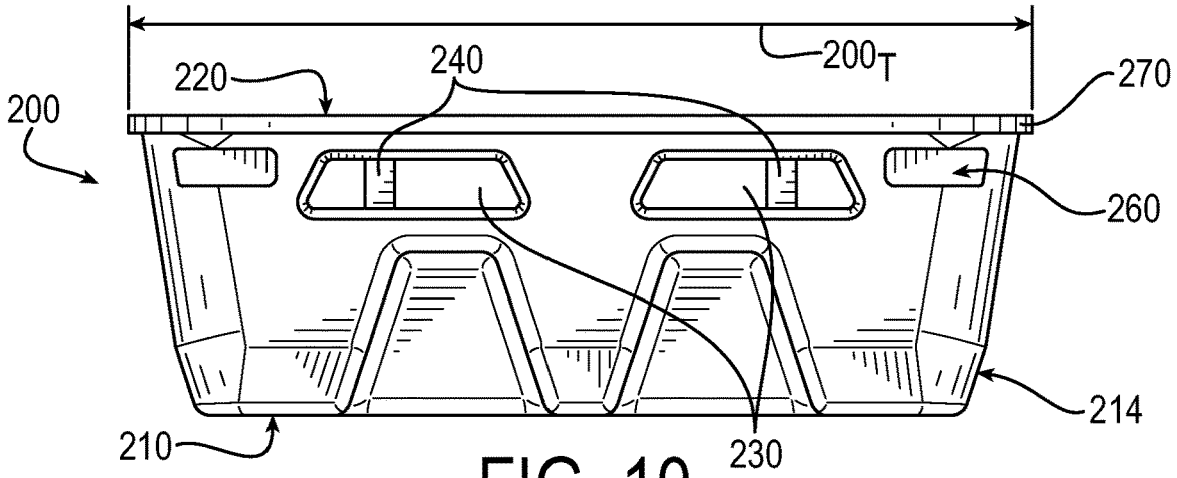
FIG. 10 is a front view of an intermediate connector with the flexible handle removed for clarity, in accordance with an example.

As illustrated by FIGS. 8-10, the intermediate connector 200 may further comprise sidewall apertures 230. The sidewall apertures 230 receive and mate with the cleats 160 of the insert when the brush handle assembly is assembled. In the example as illustrated by FIGS. 8-10 the sidewall apertures 230 are trapezoids. The sidewall apertures may be of any shape including but not limited to, rectangular, circular, or the like.

In one example and with particular reference to FIGS. 9-10, the intermediate connector 200 may further comprise support ribs 240 within the cavity 250. The support ribs 240 extend across the cavity 250 between opposing internal sidewalls 252, 254. The support ribs 240 provide for increased support of the intermediate connector during formation and to further secure and support the flexible handle when the brush handle assembly is assembled. The support ribs 240 may extend the entire depth of the cavity or a partial depth of the cavity. When extending a partial depth of the cavity 250 a flexible handle that is molded within cavity 250 fills the cavity about the support ribs 240. Specifically, the flexible handled molded within cavity 250 may form a locking engagement wherein the flexible handle encases one or more support ribs 240 within the intermediate connector 200. This provides additional support and permanently secures the flexible handle within the intermediate connector when the brush handle assembly is assembled. One or more support ribs may be provided. Likewise, multiple support ribs may be provided. In the example illustrated by FIGS. 9-10, three support ribs 240 are provided.

In FIGS. 8-10 and 12, the intermediate connector 200 may further comprise one or more exterior voids 260 for securing the ferrule to the intermediate connector 200 when the brush handle assembly is assembled. The one or more exterior voids 260 are provided in the exterior surface of the intermediate connector 200. In another example, the exterior void 260 may be an aperture extending through the sidewall of the intermediate connector 200. In the examples of FIGS. 8-10 and 12, the one or more exterior voids 260 are each positioned relative to one of the four corners of the intermediate connector 200. When the brush handle assembly is assembled the ferrule is crimped into the one or more exterior voids 260 forming a mechanical connection between the ferrule and the intermediate connector 200.

As illustrated by FIGS. 8-12, the intermediate connector may further comprise a top lip 270. In these examples, the top lip 270 is positioned to the top side 220 of the intermediate connector 200 and extends the entire perimeter of the top side 220 of the intermediate connector 200. The top lip 220 is seated to a top of the ferrule. Further, the top lip separates the top of the ferrule from the flexible handle. In other examples, one or more top lips may partially extend the perimeter of the top side of the intermediate connector. When the brush handle assembly is assembled the intermediate connector may be fully concealed or substantially concealed by the ferrule. As used herein, substantially concealed means fully concealed with the exception of one or more top lips.

Figure 13:
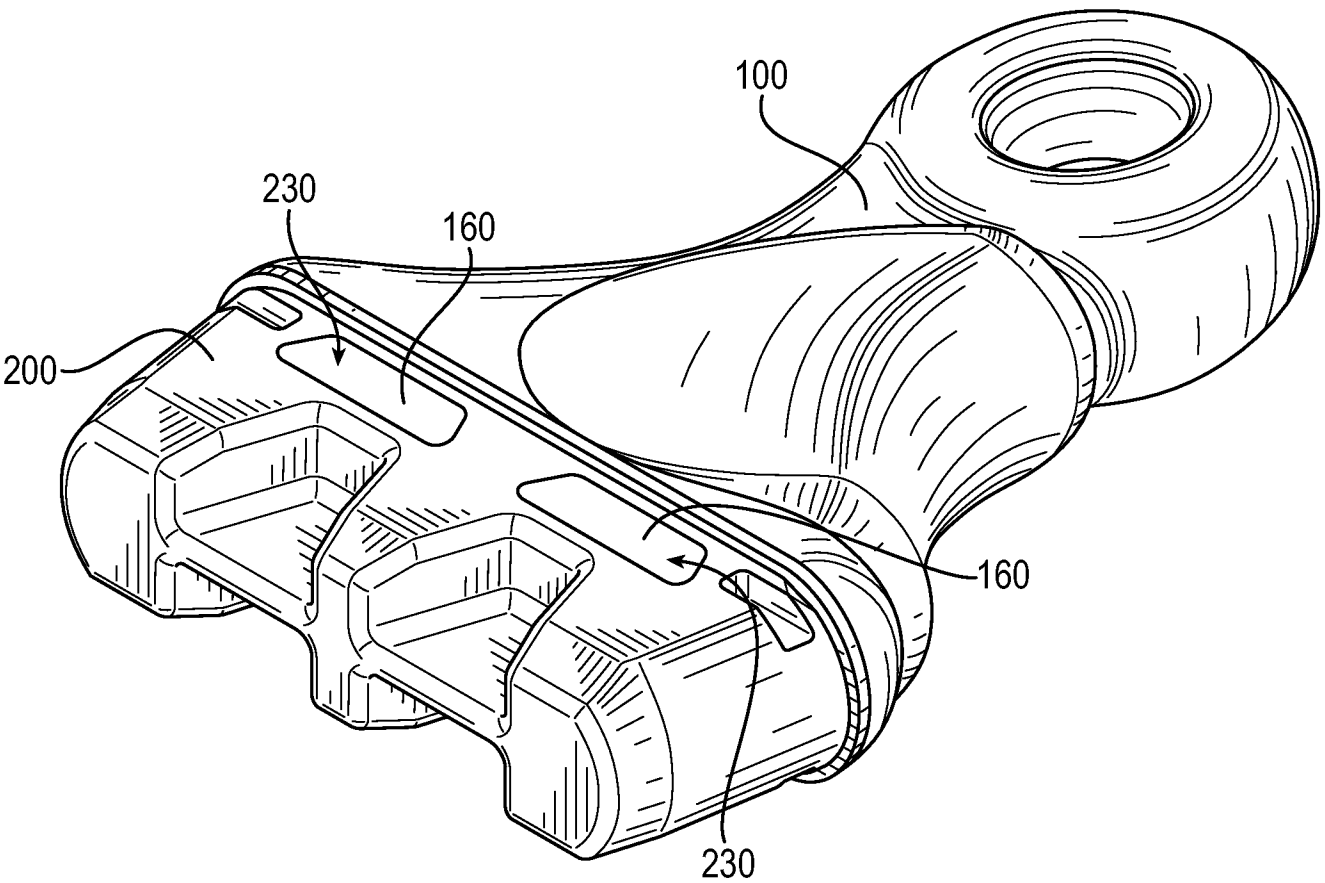
FIG. 13 is a perspective view of a flexible handle inserted or molded into an intermediate connector, in accordance with an example.
Figure 14:
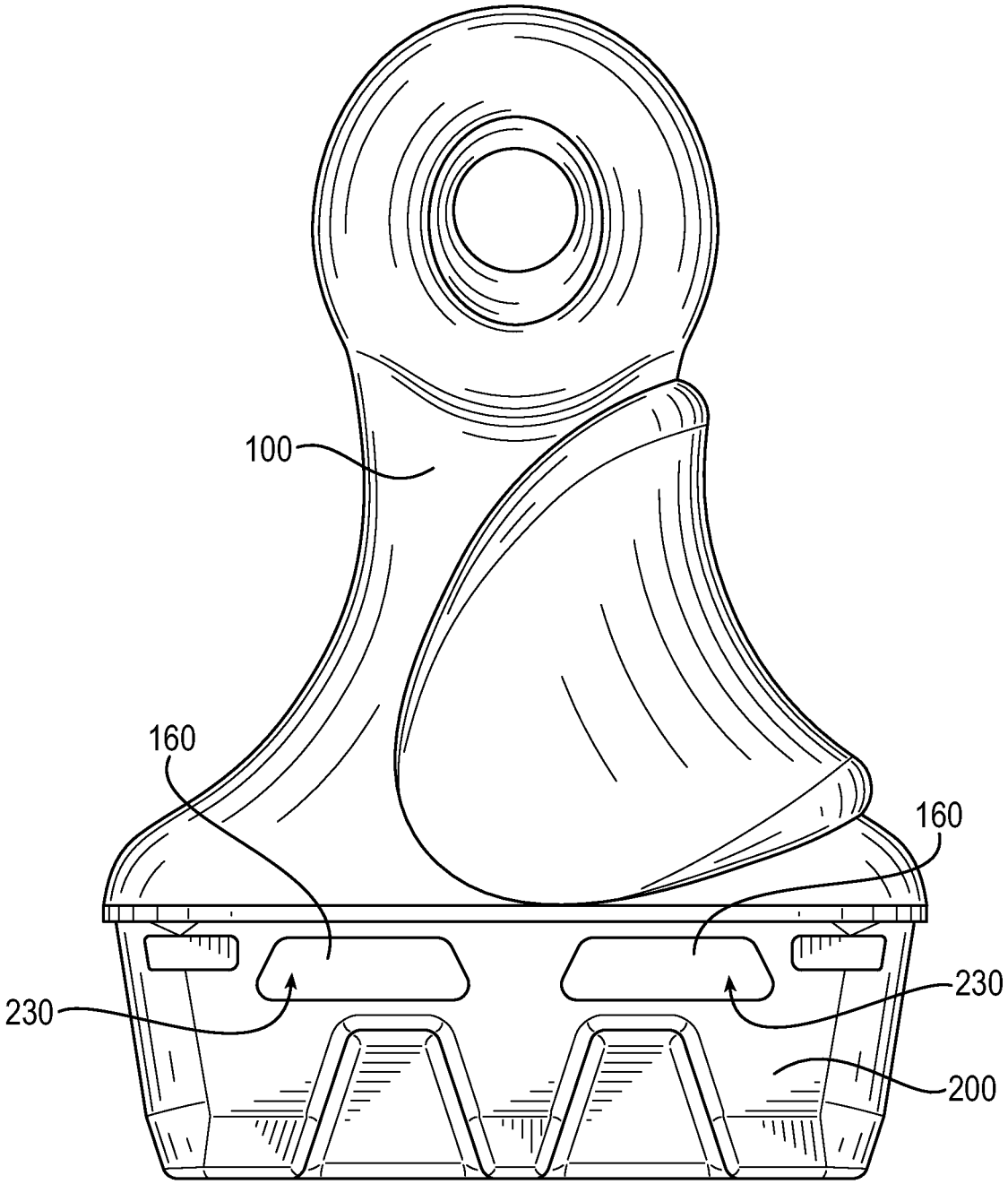
FIG. 14 is a front view of a flexible handle inserted or molded into an intermediate connector, in accordance with an example.

Turning now to FIGS. 13-14, a flexible handle 100 inserted into the intermediate connector 200 is illustrated. The one or more cleats 160 of the insert 150 of the flexible handle 100 penetrate a respective sidewall aperture 230 of the intermediate connector. The one or more cleats 160 may partially or fully fill the respective sidewall aperture 230. Upon being inserted into, molded into, and/or formed within, the flexible handle 100 is secured to the intermediate connector 200. The flexible handle 100 may be removably secured or permanently secured to the intermediate connector 200.

By extending the one or more cleats 160 of the insert 150 through a respective sidewall aperture 230 the one or more cleats are exposed through the intermediate connector 200. By exposing the one or more cleats the one or more cleats may contact, engage, or be open to the ferrule. Thereby, the one or more cleats may be additionally secured mechanically and/or by adhesive to the ferrule. Thereby, the cleats may provide a connection between each of the flexible handle, the intermediate connector, and the ferrule, in combination.

Additional examples of the present disclosure include methods for assembling a brush handle assembly. Examples of a method for assembling a brush handle assembly comprise providing an intermediate connector. The intermediate connector may comprise a cavity formed by sidewalls for receiving a flexible handle. The intermediate connector may further comprise one or more sidewall apertures for mechanically connecting a flexible handle to the intermediate connector.

In one example, a flexible handle is inserted into the intermediate connector. The flexible handle may be secured to the intermediate connector. In one example, the flexible handle may be molded. In particular, the flexible handle may be molded independent of and prior to insertion into the intermediate connector. Alternatively, the flexible handle may be molded directly into the intermediate connector. Cleats of the flexible handle may be molded into or forced into the sidewall apertures for providing a mechanical connection between the intermediate connector and the flexible handle. In other words, one or more cleats of the flexible handle may be extended through one or more sidewall apertures of the intermediate connector.

The intermediate connector may comprise one or more support ribs about which the flexible handle may be molded. By example, the flexible handle may be molded to surround each one or more support ribs on at least three surfaces, thereby, creating a locking engagement between the flexible handle and the intermediate connector. In these examples, the flexible handle may be formed or molded to partially fill the cavity of the intermediate connector or may fully fill the cavity of the intermediate connector. Adhesive may additionally be added to further secure or adhere the flexible handle to the inside surface of the intermediate connector.

The method for assembling a brush handle assembly may further comprise inserting a bottom side of an intermediate connector into a top side of a ferrule. The exterior of intermediate connector may be form fitted to mate with the inside of the ferrule. The exterior of the intermediate connector may further comprise bottom side tapers for guiding the bottom side of the intermediate connector into the top side of the ferrule. Bottom side voids may also be provided at the bottom side of the intermediate connector. The bottom side tapers and/or the bottom side voids may additionally be provided to further secure an applicator end between the intermediate connector and the ferrule at the bottom side taper and the ferrule and/or within the bottom side voids. Adhesive may additionally be provided to further secure the intermediate connector to the ferrule, secure the intermediate connector to the applicator end, secure the applicator end to the ferrule, or any combination thereof. In particular examples, the applicator end is secured to an interior and/or a bottom side of ferrule.

In one particular example, the intermediate connector is fully inserted into the ferrule. In another example, the intermediate connector is substantially inserted into the ferrule.

The method for assembling a brush handle assembly may further comprise crimping the ferrule into one or more exterior voids of the intermediate connector. By crimping, or forcing the material of the ferrule into the one or more exterior voids of the intermediate connector, the ferrule and the intermediate connector are mechanically secured to one another. Adhesive may be used in combination with a mechanical connection to further secure the intermediate connector to the ferrule.

The terms "comprising," "including," and "having," as used in the claims and specification herein, shall be considered as indicating an open group that may include other elements not specified. The terms "a," "an," and the singular form of words shall be taken to include the plural form of the same words, such that the terms mean that one or more of something is provided. The terms "at least one" and "one or more" are used interchangeably. The term "single" shall be used to indicate that one and only one of something is intended. Similarly, other specific integer values, such as "two," are used when a specific number of things are intended. The terms "preferably," "preferred," "prefer," "optionally," "may," and similar terms are used to indicate that an item, condition or step being referred to is an optional (i.e., not required) feature of the invention.

While this description has been described with reference to particular examples thereof, it shall be understood that such description is by way of illustration only and should not be construed as limiting the scope of the claimed invention. Accordingly, the scope and content of the invention are to be defined only by the terms of the following claims. Furthermore, it is understood that the features of any specific example discussed herein may be combined with one or more features of any one or more embodiments otherwise discussed or contemplated herein unless otherwise stated

What is claimed is:

1. A brush handle assembly comprising:

a ferrule, an intermediate connector positioned within a top side of the ferrule and substantially concealed by the ferrule, and a flexible handle positioned within a top side of the intermediate connector and secured within at least one lateral side of the intermediate connector that is concealed by the ferrule.

2. The brush handle assembly of claim 1 wherein a section of the flexible handle is molded into a cavity of the intermediate connector.

3. The brush handle assembly of claim 2 wherein the intermediate connector includes one or more sidewall apertures penetrated by one or more cleats of the flexible handle.

4. The brush handle assembly of claim 3 wherein the one or more cleats extend laterally from a bottom side of the flexible handle.

5. The brush handle assembly of claim 4 wherein at least two cleats extend laterally from a first lateral side of the flexible handle and at least two additional cleats extend laterally from a second lateral side of the flexible handle.

6. The brush handle assembly of claim 1 further comprising at least one support rib extending across a cavity within the intermediate connector.

7. The brush handle assembly of claim 6 wherein the handle is in a locking engagement with the at least one support rib.

8. The brush handle assembly of claim 6 wherein the at least one support rib extends a partial depth of the cavity.

9. The brush handle assembly of claim 3 further comprising at least one support rib extending across a cavity within the intermediate connector wherein the at least one support rib bisects at least one sidewall aperture.

10. The brush handle assembly of claim 1 wherein the intermediate connector includes one or more sidewall apertures penetrated by the flexible handle.

11. The brush handle assembly of claim 1 wherein the intermediate connector is tapered and narrows from the flexible handle to the ferrule.

12. The brush handle assembly of claim 1 wherein the intermediate connector further comprises a top lip extending a perimeter of the top side of the ferrule.

13. The brush handle assembly of claim 12 wherein the top lip separates the top side of the ferrule from the flexible handle.

14. An intermediate connector for use in a brush handle assembly, the intermediate connector comprising:

an enclosed bottom side, a top side, and a cavity formed therein and open at the top side; and at least one sidewall aperture extending from the cavity through a sidewall between the enclosed bottom side and the top side.

15. The intermediate connector of claim 14 further comprising at least one support rib extending across the cavity.

16. The intermediate connector of claim 15 wherein the at least one support rib extends across the cavity at the top side.

17. The intermediate connector of claim 15 wherein the at least one support rib extends a partial depth of the cavity.

18. The intermediate connector of claim 15 wherein the at least one support rib bisects at least one sidewall aperture.

19. The intermediate connector of claim 15 further comprising a top lip extending a perimeter of the top side.

20. A method for making a brush handle assembly, the method comprising:

molding a flexible handle into a cavity open at a top side of an intermediate connector;

extending one or more cleats of the flexible handle through a sidewall aperture of the intermediate connector independent of a bottom side and the top side of the intermediate connector for securing the flexible handle to the intermediate connector;

inserting a bottom side of the intermediate connector into a top side of a ferrule wherein the one or more cleats of the flexible handle are exposed to an inside surface of the ferrule through the sidewall aperture of the intermediate connector; and crimping the ferrule into at least one exterior void of the intermediate connector.

* * * * *